United States Patent [19]

Lenk

[11] Patent Number: 4,704,077

[45] Date of Patent: Nov. 3, 1987

[54] MELT SPINNING APPARATUS

[75] Inventor: Erich Lenk, Remscheid, Fed. Rep. of Germany

[73] Assignee: Barmag AG, Remscheid, Fed. Rep. of Germany

[21] Appl. No.: 787,650

[22] Filed: Oct. 16, 1985

[30] Foreign Application Priority Data

Oct. 16, 1984 [DE] Fed. Rep. of Germany ..... 3437771
Nov. 14, 1984 [DE] Fed. Rep. of Germany ..... 3441599

[51] Int. Cl.[4] ..... B29C 47/30

[52] U.S. Cl. ..... 425/131.5; 425/192 S; 425/382.2

[58] Field of Search ..... 425/72 S, 131.5, 190, 425/191 S, 192 S, 378 S, 379 S, 382.2, 464, DIG. 49, DIG. 217, 197–199; 264/176 F, 176.1

[56] References Cited

U.S. PATENT DOCUMENTS

| | | | |
|---|---|---|---|
| 3,061,874 | 11/1962 | Lees | 425/72 S |
| 3,387,327 | 6/1968 | Privott, Jr. et al. | 425/131.5 |
| 3,407,437 | 10/1968 | Lenk | 425/376 A |
| 3,466,703 | 9/1969 | Heckrotte | 425/131.5 |
| 3,559,237 | 2/1971 | Biggelaar et al. | 425/192 S X |
| 3,570,059 | 3/1971 | Mott | 425/382.2 X |
| 3,601,846 | 8/1971 | Hudnall | 425/131.5 |
| 3,938,925 | 2/1976 | Lees | 425/382.2 X |
| 4,038,005 | 7/1977 | Lenk | 425/190 |
| 4,406,850 | 9/1983 | Hills | 425/131.5 X |

*Primary Examiner*—Richard L. Chiesa
*Attorney, Agent, or Firm*—Bell, Seltzer, Park & Gibson

[57] ABSTRACT

A melt spinning apparatus is disclosed for extruding and spinning a thermoplastic melt, and which is adapted to accommodate high melt pressures. The apparatus includes a melt supply head having melt supply duct means extending therethrough, with the melt supply duct means including a plurality of separate duct chambers connected in parallel, and with each duct chamber mounting a filter. The outlets of the duct chambers communicate with a cavity located on the upstream side of a spin plate, and such that the melt passes through the filters and then through the spin plate. The presence of the several filtering duct chambers permits the area upstream of the filters and which is exposed to the high pressure melt to be minimized, to thereby minimize the axial forces operative on the components of the spinning head by reason of the melt pressure.

20 Claims, 7 Drawing Figures

MELT SPINNING APPARATUS

The present invention relates generally to a melt spinning apparatus for extruding and spinning thermoplastic material, and more particularly to a melt spinning apparatus which is adapted to operate at high melt pressures.

U.S. Pat. No. 3,407,437 discloses a melt spinning apparatus which is adapted to withstand pressures of more than about 1000 bar. The apparatus comprises a spinning head which includes a cylindrical casing, and with a distribution member and a ring collar threadedly joined to the casing. The ring collar serves as a holder for the spin plate. In addition, a filter chamber is positioned above the distribution member, with the diameter of the filter chamber substantially corresponding to the diameter of the distribution member. The space between the distribution member and the spin plate, and the space between the distribution member and the filter chamber are each laterally sealed by a suitable sealing member.

In the above spinning apparatus, it is noteworthy that the lateral walls of the casing are not exposed to high pressure, in view of the fact that the high pressure of the melt is considerably reduced in the filter and in the distribution member. As a result, the pressure forces are only significant in the direction of the melt flow, and these axial forces result in relatively high stress on the connecting members which hold the individual components of the melt spinning apparatus together.

It is accordingly an object of the present invention to provide a melt spinning apparatus adapted for high pressure operation, and which serves to substantially reduce the axial forces operative on the spinning head, so as to reduce the stress on the connecting members.

It is also an object of the present invention to provide a melt spinning apparatus of the described type which is of simplified construction.

These and other objects and advantages of the present invention are achieved in the embodiments illustrated herein by the provision of a melt spinning apparatus which comprises a melt supply head having melt supply duct means extending therethrough, with the melt supply duct means including a plurality of separate duct chambers connected in parallel and with each duct chamber having an outlet opening. A filter is mounted in each of the duct chambers. The apparatus further includes a nozzle assembly including a spin plate having a plurality of openings extending therethrough, and a holder enclosing and supporting the spin plate. Means are also provided for mounting the holder to the melt supply head such that the outlet openings of the duct chambers communicate with one side of the spin plate. Preferably, the melt supply head and the nozzle assembly are configured to define a cavity between the outlet openings and the spin plate.

As will be apparent, the present invention deviates from the prior practice of providing a single filter chamber in the spinning head for receiving a relatively large filter. Rather, the overall filter surface of the present invention is distributed over several individual, relatively small filters which are accommodated in the relatively small separate duct chambers of the melt supply duct means. The duct chambers are preferably located in a solid, pressure resistant portion of the melt supply head, and they are individually connected to a common inlet duct segment of the melt supply duct means at their upstream end, while their downstream ends terminate in the cavity immediately above the spin plate.

The advantages of the present invention become clear when it is considered that the high melt pressures, of for example 1000 bar, prevail only on the upstream side of the filters, and that the filters are designed with the knowledge that a substantial drop of pressure will occur, which leads to an increase of the melt temperature. As a result, the high pressure appears only at the junction between the common inlet duct segment of the melt supply duct means and the separate duct chambers, and thus only relatively small forces are operative on the connecting members of the spinning head. In addition, there is only a relatively small pressure, for example 1/10 of the initial pressure, in the cavity formed between the outlet openings of the duct chambers and the spin plate. Thus the forces to be absorbed by the spin plate and its holder, are also relatively small.

In accordance with the present invention, the intended throttling of the melt flow occurs in a plurality of separate filtering duct chambers, which are accommodated in a solid structural unit, and such that the inlets to the separate duct chambers communicate directly with the common duct segment and such that the sum of the cross-sectional areas of the inlets is not greater, or only slightly greater, than the cross sectional area of the common inlet duct segment.

In one preferred embodiment, the melt supply head itself is constructed as a solid structural unit, and the spin plate is pressed against the bottom of the structural unit by its holder. Thus pressure forces develop only at the junction where the melt supply head is connected to the external line leading from the extruder, metering pump, or other structural component of the spinning system. To absorb these pressure forces, standard pipe connections, such as a threaded nipple, may be used without difficulty. However, this embodiment of the melt supply head requires the layout of a relatively complicated system of the duct chambers and connecting bores.

To avoid the above complication, it is further proposed that the melt supply head may comprise a casing having a generally cylindrical bore therein to define a depending cylindrical flange, with a distribution member, which is in the form of a solid cylinder, being mounted within the cylindrical flange for movement in the axial direction. In this embodiment, the duct chambers for the filters are contained in the distribution member, and they terminate on the upper surface of the distribution member within a cross sectional area which corresponds to the cross sectional area of the outlet of the common inlet duct segment which extends through the casing. An annular seal is disposed between the distribution member and the adjacent surface of the casing, with the seal closely surrounding the outlet opening of the common inlet duct segment. Since the cross section of this area is relatively small, the pressure forces which are operative on the distribution member are also relatively small.

In view of the relatively small cross sectional area which is subject to the high pressure between the distribution member and the casing, it is possible that the pressure in the cavity between the distribution member and the spin plate is sufficient to bias the distribution member upwardly against the seal which surrounds the outlet opening. This is true despite the throttling effect and the reduction in pressure of the melt caused by the filters. However, it is also possible to mechanically apply the necessary sealing forces, such as for example, the distribution member may be pressed against the seal by means of a screw type spin plate holder.

The separate duct chambers for the filters are preferably each in the form of a hollow cylinder. A closure may be provided for closing the lower end of each chamber, for example by a threaded interconnection. Each filter may be of an elongated, generally cup shape, and mounted so that its downstream end which is adjacent the spin plate is open, and its other or upstream end is closed. Thus the melt radially penetrates the filter, then flows into the bore of the filter, through the open end, and into the cavity between the distribution member and the spin plate. It is possible to reverse this orientation of the filter, so that the melt first enters into the open free end of the filter, and then flows through the filter from the inside radially outwardly. However, this latter arrangement is somewhat less desirable, since a higher strength for the filter is required and the service life will be somewhat shorter than in the case where the flow through the filter is from the outside to the inside.

In each embodiment of the invention, the duct chambers terminate downwardly in the cavity formed between the melt supply head and the spin plate. In the cavity, the melt is distributed to the individual openings of the spin plate. The duct chambers may have their axes disposed either perpendicularly or obliquely with respect to the spin plate. Preferably, the outlets of the duct chambers are symmetrically distributed over the surface of the spin plate, so that there is a substantially equal flow through all of the openings in the spin plate.

In one embodiment, the duct chambers may include inlets, and wherein the sum of the cross sections of the inlets are less than the cross section of the common inlet duct segment. Thus in this embodiment the perpendicular or inclined duct chambers are connected via bores to the common inlet duct segment, with the bores being located in the solid portion of the melt supply head. This embodiment is particularly useful when a plurality of filter chambers are positioned in a relatively small melt supply head.

To the extent that there are no space problems, the duct chambers may also be arranged so that they all meet at their inlet end with the outlet of the common inlet duct segment. When the duct chambers are obliquely disposed, e.g. disposed in a conical arrangement, their axes preferably meet in one point, which is located on the axis of the common inlet duct segment.

In the present invention, only the holder of the spin plate needs to be connected to the casing of the melt supply head so as to mechanically resist the pressure. For this purpose, it is preferred to use a screw thread interconnection, such as a multiple thread, or a thread partially recessed over circumferential areas to provide a bayonet type joint or the like. Thus for example, the mechanical connection may comprise an external thread on the holder, and a mating internal thread on the casing.

A problem often associated with the prior art melt spinning devices of the described type, resides in the fact that a portion of the melt may penetrate from the cavity between the distribution member and the spin plate into the mounting threads, and may interfere with the threaded interconnection upon solidification. This problem is avoided in one embodiment of the present invention in that the holder of the nozzle assembly is provided with a tubular extension which extends above the spin plate, with the inside cross section of the extension closely conforming to the cross section of the distribution member. The casing then includes a depending flange coaxially surrounding the tubular extension, and the tubular extension is provided with an external screw thread on its outside surface for engaging a corresponding internal thread formed on the depending flange of the casing. Thus the spin plate holder becomes a part of a cylindrically shaped interior into which the distribution member is slideably movable in the manner of a piston. In this regard, it should be noted that the distribution member needs to move only to the extent necessary for sealing.

The interior area defined by the depending flange of the casing and the tubular extension of the spin plate holder, and which receives the distribution member, may be constructed in the form of stepped surfaces, leaving open the possibility of providing either the spin plate or the casing with a smaller inside cross section. However, it is preferred that the depending flange and the tubular extension have portions with the same inside diameter, in which case it is necessary that the axial portion of the depending flange containing the screw thread have a larger cross section than the axial portion which engages the distribution member.

The distribution member, spin plate, and spin plate holder are dimensioned so that the distribution member is held against the annular seal which surrounds the opening of the common inlet duct segment when the holder is threadedly connected to the casing. As a result, the melt is prevented from radially penetrating into the area between the upper surface of the distribution member and the adjacent surface of the casing. Also, by reason of the relatively large cross sectional area of the cavity between the distribution member and spin plate, the upwardly directed pressure force which assists in the sealing effect may be greater than the pressure force operative in the opposite direction, to thereby insure a constant sealing effect.

It should be noted that in one embodiment of the present invention the distribution member is designed as a piston guided for limited movement in a cylindrical bore defined within the tubular extension of the holder and the depending flange of the casing. However, it is not necessary that the tubular extension of the holder and/or the cylindrical flange of the casing be adapted to the cylindrical shape of the distribution member along their entire axial length. Rather, recesses may be present along the axial length.

Some of the objects and advantages of the present invention having been stated, others will appear as the description proceeds, when taken in conjunction with the accompanying drawings, in which FIG. 1 is a sectional side elevation view of a melt spinning apparatus which embodies the features of the present invention;

Figure 1:
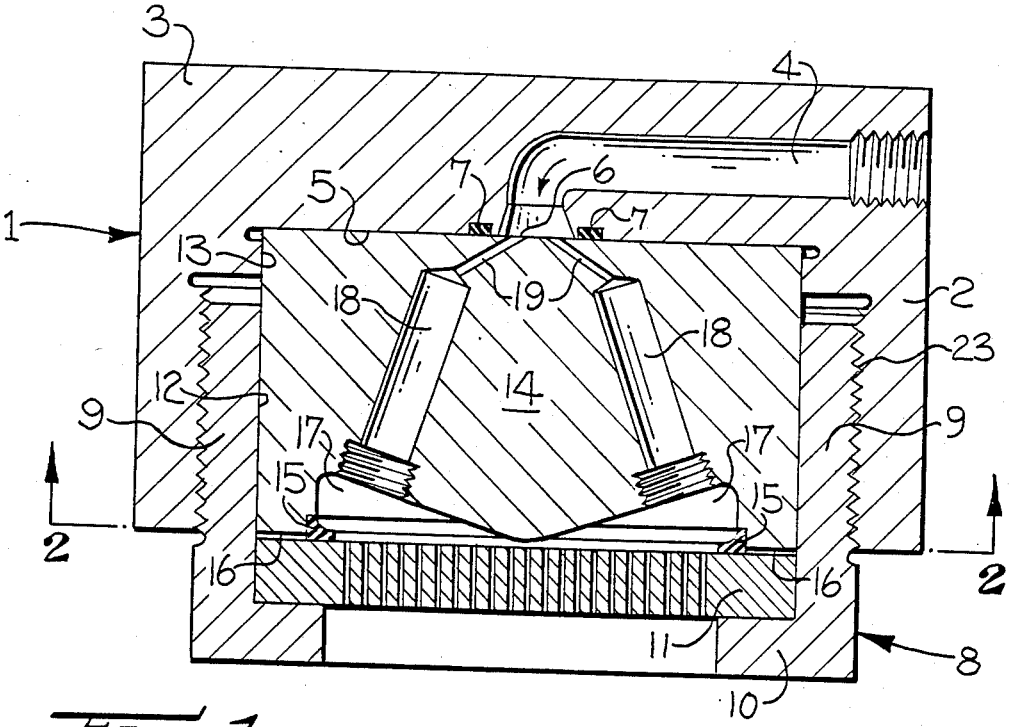
Figure 2:
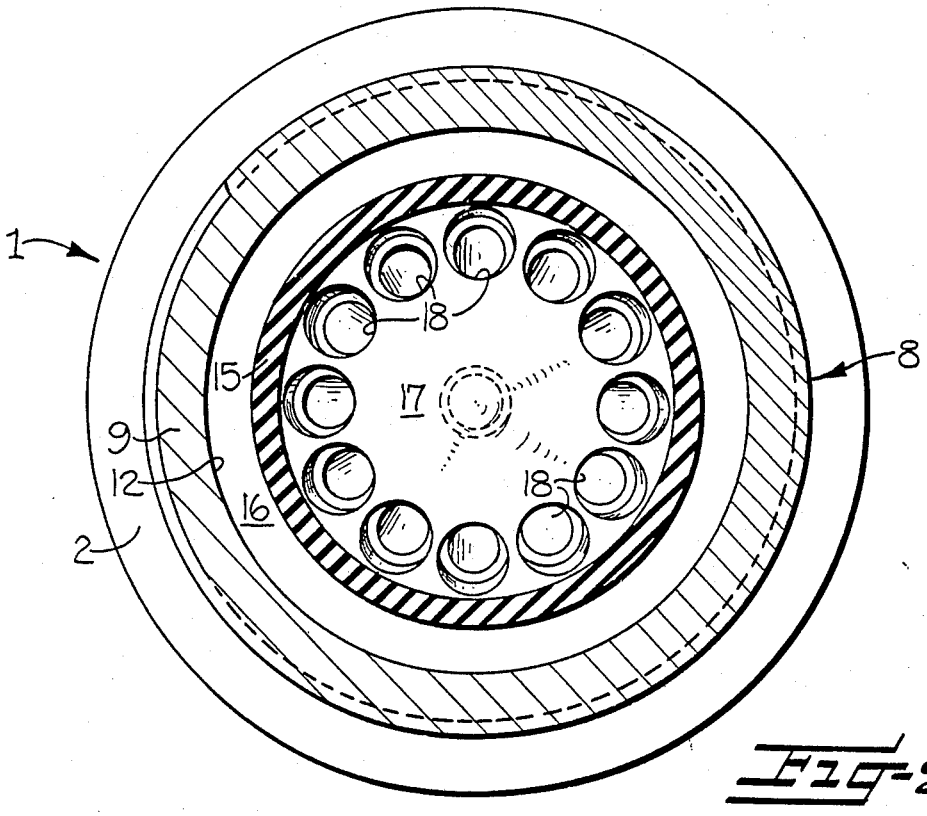
FIG. 2 is a sectional plan view taken substantially along the line 2—2 of FIG. 1.
Figure 3:
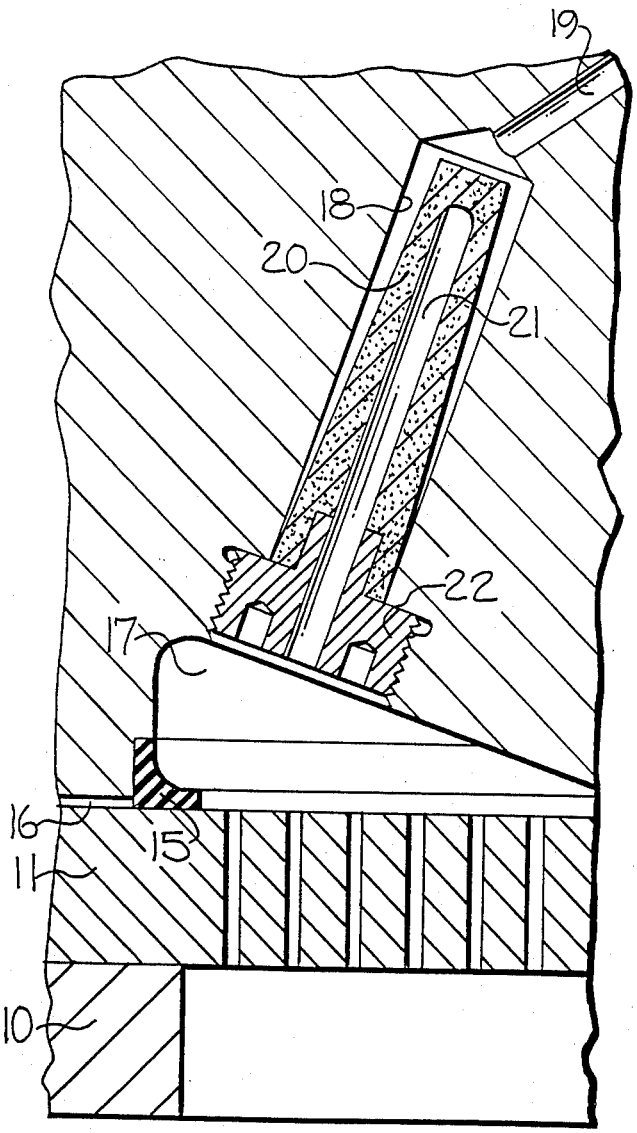
FIG. 3 is an enlarged fragmentary view of one of the duct chambers as shown in FIG. 1.

Referring more particularly to the embodiment illustrated in FIGS. 1–3, there is illustrated a melt spinning apparatus for extruding and spinning a thermoplastic material, and which comprises a melt supply head 1 composed of a casing 3 and a distribution member 14. Melt supply duct means extends through the casing and distribution member, and includes a common duct segment 4 extending through the casing, and a plurality of separate duct chambers 18 connected in parallel and positioned within the distribution member 14. A filter 20 is positioned in each of the chambers, as further described below.

The casing 3 of the melt supply head includes a depending cylindrical flange defining an internal bore and an internal thread 23 is formed in the wall of the flange over a portion of its length. The bore also defines a bottom surface 5, and an inner cylindrical portion 13 which is adjacent the bottom surface 5 so as to be positioned between the bottom surface 5 and the internal threads 23. The common inlet duct segment 4, which is connected to a melt pump or the like (not shown) terminates in an outlet 6 which communicates with substantially the center of the bottom surface 5 of the bore. An annular seal 7 surrounds the outlet 6 and is positioned between the bottom surface 5 and the adjacent upper surface of the distribution member 14.

The melt spinning apparatus further comprises a nozzle assembly which includes a spin plate 11 having a plurality of openings extending therethrough, and a holder 8 which encloses and supports the spin plate. The holder includes a tubular extension 9 which is externally threaded, and which is adapted to engage the thread 23 of the casing. The holder 8 also includes a radial shoulder 10 which serves to underlie and thus support the spin plate 11. In the illustrated embodiment, the inside of the tubular extension 9 defines a cylindrical surface 12 having a diameter equal to the inside diameter of the surface portion 13 of the casing. In addition, the distribution member 14 is in the form of a cylindrical piston which is fitted into and adapted to slide in the cylindrical interior defined by the inside surface 12 of the extension 9 and the surface portion 13 of the casing.

A cavity 17 is formed in the lower surface 16 of the distribution member 14. The cavity 17 is of a circular outline, and has a cross section formed so that its depth increases from the center toward the outside. This shape serves to influence the flow conditions in the cavity 17 between the distribution member 14 and the spin plate 11. The cavity 17 is sealed by means of an annular self sealing member 15, note FIG. 3. The sealing member 15 includes an angular profile, which is designed such that the pressure existing in the cavity 17 presses the surfaces of the sealing member against the adjacent surfaces of the distribution member 14 and spin plate 11, to effect a seal therebetween.

The distribution member 14 and the spin plate 11 are dimensioned in the direction ot melt flow, so that the spin plate is sealingly held against the sealing member 15 or the surface 16 of the distribution member, when the holder 8 is threaded into the flange of the casing. Also, the distribution member is pressed against the seal 7. However, it is not necessary that a very strong axial force be applied, inasmuch as the pressure in the cavity 17 serves to press the sealing member 15 against the sealing surfaces, which surround the space between the lower surface of the distribution member 14 and the spin plate 11. Further, the cross section of the cavity 17 is quite large in comparison to the area of the outlet 6 of the inlet duct segment 4, and as a result, the distribution member is self sealingly pressed against the seal 7 which surrounds the outlet 6.

Figure 4:
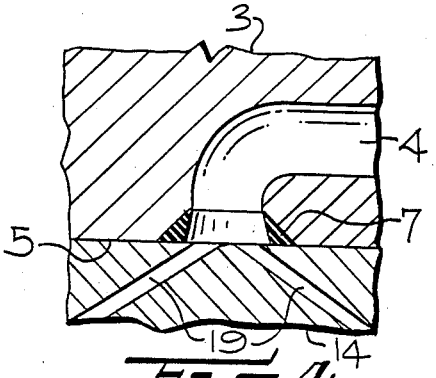
FIGS. 4 and 5 are fragmentary views illustrating two different embodiments of seals between the casing of the melt supply head and the distribution member.
Figure 5:
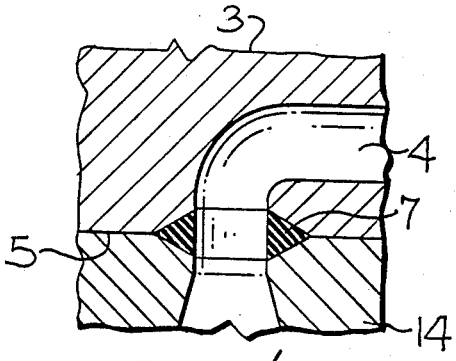

Additional embodiments of the seal surrounding the outlet 6 are illustrated in FIGS. 4 and 5. In each case, the junction between the surface 5 and the outlet 6 is wedge-shaped, and a correspondingly shaped seal 7 is inserted into the wedge-shaped gap. The pressure operative in the inlet duct segment 4 at the outlet 6 is effective to press the seal 7 into the wedge-shaped gap and thus the sealing effect of the seal is aided and increased by the pressure of the melt.

The melt supply duct means extends through the distribution member 14, and this portion of the melt supply duct means is in the form of a plurality of inlet bores 19 which extend from an area aligned with the outlet 6 to respective ones of the duct chambers 18. The inlet bores 19 thus define inlet end portions of the separate duct chambers 18, and as will be apparent from the drawings, these inlet end portions directly communicate with the common inlet duct segment 4 within a transverse area which is not substantially greater in transverse dimension than the transvers dimension of the common inlet duct segment 4. A filter 20 is inserted in each of the chambers 18 as best seen in FIG. 3, with each filter 20 being of an elongated cup shape so as to define an internal bore 21. The open end of each filter 20 is mounted on a closure 22, which is threadedly joined at the outlet opening of the chamber 18. An axial bore extends through the closure 22 and communicates with the bore 21 of the filter. Thus the melt entering through the inlet duct 19 into the duct chamber 18 first penetrates the filter 20 radially from the outside to the inside, and reaches the axial bore 21. The melt then flows through the closure 22 and into the cavity 17, and it then proceeds through the openings of the spin plate 11. As can be further seen in FIG. 3, each filter 20 has a conical outer surface, so that a tapered cavity is formed between the filter and the wall of the chamber 18 for receiving the melt along the axial length of the filter.

The melt spinning apparatus of the present invention is particularly suitable for high melt pressures, for example 1000 bar, since the pressure of the melt effects a stress of the spinning head only in the area of the relatively small outlet 6 of the inlet duct segment 4. The several filters 20 in the chambers 18 mounted in the distribution member 14 provide a large filtering surface, and in addition, their arrangement in the distribution member prevents the melt supply head from having to absorb the high pressure forces present on the filters. Rather, the distribution member 14, which is of solid construction, serves this purpose. The pressure present in the cavity 17 is substantially reduced by the throttling caused by the filters, and thus the threaded connection between the flange of the casing and holder 8 needs only to withstand the pressure forces resulting from this reduced melt pressure in the cavity 17.

Figure 6:
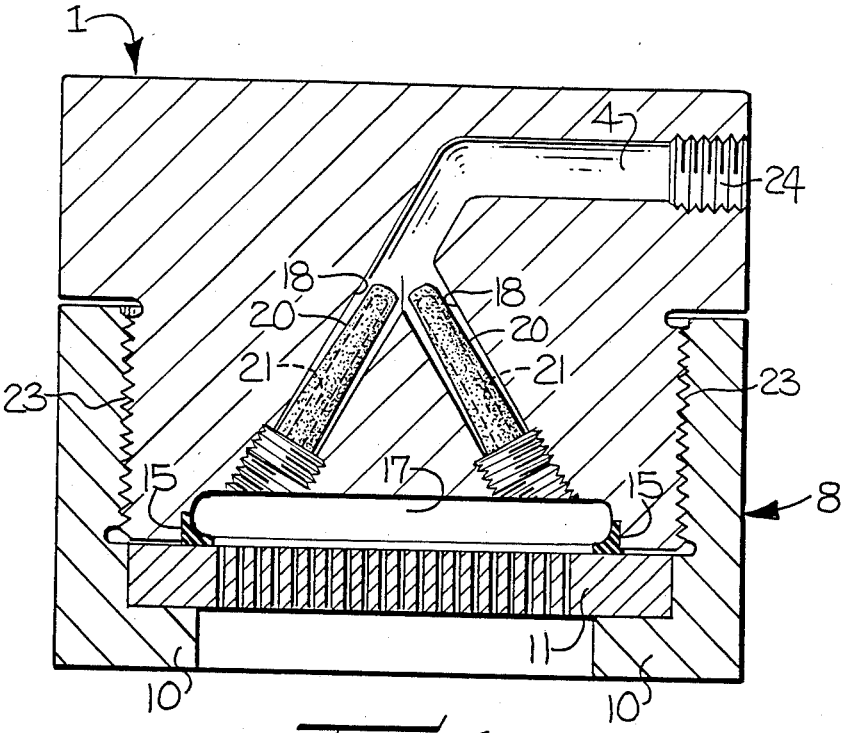
FIG. 6 is a sectional side elevation view of a further embodiment of the present invention.
Figure 7:
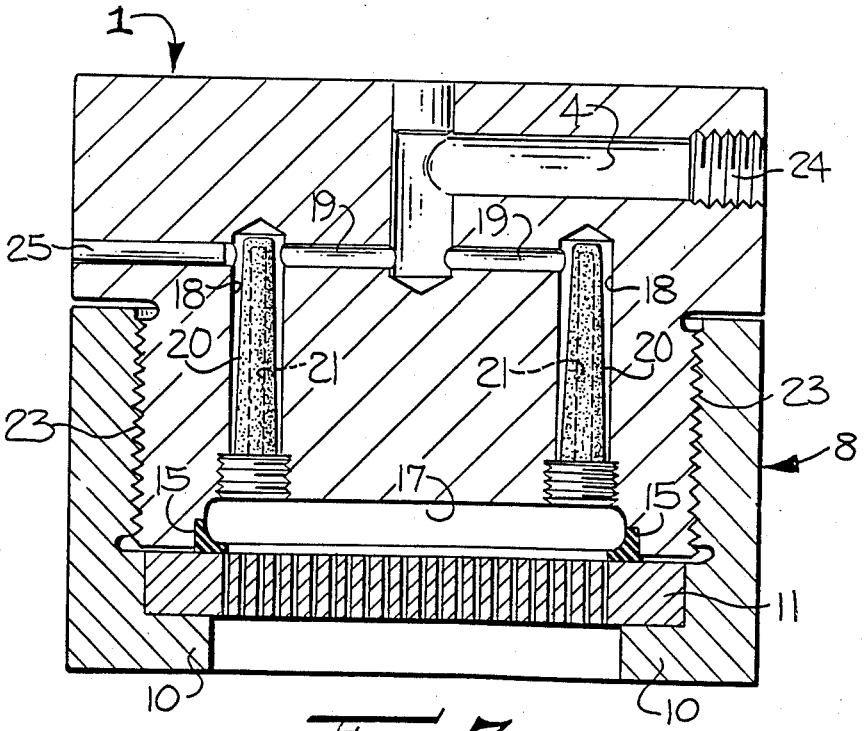
FIG. 7 is a sectional side elevation view of still another embodiment of the invention.

In the embodiments of FIGS. 6 and 7, the melt supply head includes an integral depending connecting plug of circular cross section. The plug defines a cavity 17 in its bottom surface, which communicates with the upper surface of the spin plate 11. The cylindrical plug includes an external screw thread 23 upon which the holder 8 is threadedly joined. The spin plate 11 is supported by the shoulder 10 of the holder, and is firmly pressed against the connecting plug. The space between the spin plate 11 and the adjacent surface of the connecting plug is sealed about the periphery of the cavity 17 by a member 15, which has an angular profile to effect self-sealing in the manner described above with respect to the embodiment of FIGS. 1–3.

The connecting plug of the head 1 accommodates a plurality of duct chambers 18, which are in the form of hollow cylinders. The ends of the cylinders which communicate with the cavity 17 include a screw thread, into which a mounting closure 22 for the filters 20 can be secured. The filters 20 include an elongate axial bore 21 which is closed at the upper end, and with the bore 21 communicating through the closure 22 with the cavity 17. The filters are slightly tapered, and the melt flows around and through the filters from the outside to the inside.

In the embodiment of FIG. 6, the duct chambers 18 are arranged in a conical, equally spaced apart arrangement, with the apex of the cone lying in the center of the inlet duct segment 4. This arrangement is suitable where only a limited number of duct chambers 18 are needed to achieve the desired flow rate of the melt. Also, the inlet duct segment 4 enters the casing laterally from the opening 24 and bends in a direction substantially perpendicular to the flow direction of the melt. The pressure forces exerted by the melt are operative in the area of the opening 24, but the opening area is relatively small, and in addition, the pressure forces may be readily absorbed by a threaded connection at that location.

In the embodiment of FIG. 7, the several filter chambers 18 are disposed perpendicularly to the spin plate 11, and are parallel to each other in a circular arrangement. Lateral inlet bores 19 connect the individual duct chambers 18 with the common inlet duct segment 4. Here again, the bores 19 define inlet end portions of the separate duct chambers 18, and the inlet end portions directly communicate with the common inlet duct segment 4 within a transverse area which is not substantially greater in transverse dimension than the transverse dimension of the common inlet duct segment 4. The bores 19 may be formed from one side of the head radially inwardly, and are closed adjacent the outer end by means of a suitable plug 25. Also, in this embodiment the high melt pressure of for example 1000 bar, remains ineffective outside of the melt supply head, since the unitary head absorbs the forces and no external pressures develop other than at the opening 24 of the melt supply duct 4. Again, these pressure forces may be readily absorbed by providing a threaded joint at the opening 24.

In the drawings and specification, there has been set forth a preferred embodiment of the invention, and although specific terms are employed, they are used in a generic and descriptive sense only and not for purposes of limitation.

That which is claimed is:

1. A melt spinning apparatus for extruding and spinning a thermoplastic material, and comprising a melt supply head having melt supply duct means extending therethrough, with said melt supply duct means including a common inlet duct segment and a plurality of separate elongated cylindrical duct chambers connected in parallel, and with each of said separate duct chambers including an inlet end portion directly communicating with said common inlet duct segment within a transverse area which is not substantially greater in transverse dimension than the transverse dimension of said common inlet duct segment, and with each of said separate duct chambers also having an outlet opening, and a filter mounted in each of said duct chambers, a nozzle assembly including a spin plate having a plurality of openings extending therethrough, and a holder enclosing and supporting said spin plate, and means mounting said holder of said nozzle assembly to said melt supply head such that said melt supply head and said nozzle assembly define a cavity between said outlet openings and said spin plate, and said outlet openings of said duct chambers thereby communicate with one side of said spin plate.

2. The melt spinning apparatus as defined in claim 1 wherein said outlet openings are in a circular, equally spaced apart arrangement communicating with said cavity.

3. The melt spinning apparatus as defined in claim 1 wherein said separate duct chambers are disposed in a conical, equally spaced apart arrangement, with said inlet end portions of said duct chambers communicating directly with each other and with said inlet duct segment.

4. The melt spinning apparatus as defined in claim 1 wherein said separate duct chambers are disposed parallel to each other.

5. The melt spinning apparatus as defined in claim 1 further comprising sealing means interposed between said melt supply head and said spin plate and surrounding the periphery of said cavity.

6. The melt spinning apparatus as defined in claim 1 wherein said melt supply head comprises a casing having a bore therein which defines an inner bottom surface and a depending cylindrical flange, and wherein said melt supply head further includes a separate distribution member disposed in said bore, with said distribution member having an upper surface opposing said bottom surface of said bore.

7. The melt spinning apparatus as defined in claim 6 wherein said common inlet duct segment extends through said casing and terminates in an outlet which communicates with substantially the center of said bottom surface, and said inlet end portions of said separate duct chambers are located in said distribution member and proceed from an area directly opposite said outlet in said bottom surface.

8. The melt spinning apparatus as defined in claim 7 wherein an annular seal is disposed about said outlet in said bottom surface and so as to be between said bottom surface and said upper surface of said distribution member, said annular seal having a transverse dimension only slightly greater than the transverse dimension of said outlet.

9. The melt spinning apparatus as defined in claim 8 wherein said distribution member includes a lower surface, and wherein said lower surface is clampingly engaged by said nozzle assembly so as to press said distribution member in a direction toward said bottom surface of said melt supply head and so that said upper surface of said distribution member is pressed against said annular seal.

10. The melt spinning apparatus as defined in claim 9 wherein said distribution member has a cylindrical outer periphery, and wherein said holder of said nozzle assembly includes a tubular extension which projects beyond said spin plate, with said tubular extension having a cylindrical bore which closely receives said cylindrical periphery of said distribution member therein.

11. The melt spinning apparatus as defined in claim 10 wherein said means mounting said holder to said melt supply head comprises a threaded connection between said depending flange of said casing and said tubular extension of said holder.

12. The melt spinning apparatus as defined in claim 11 wherein said bore of said casing further includes a cylindrical portion closely adjacent said bottom surface and which closely receives a portion of said cylindrical outer periphery of said distribution member therein.

13. The melt spinning apparatus as defined in claim 1 wherein said melt supply head includes a cylindrical connecting plug, with said melt supply duct means extending through said connecting plug, and wherein said holder of said nozzle assembly includes a tubular extension which is adapted to coaxially receive said connecting plug therein, and wherein said means mounting said holder to said melt supply head includes cooperating threads formed on said connecting plug and said tubular extension of said holder.

14. The melt spinning apparatus as defined in claim 13 wherein each of said separate duct chambers is at least substantially positioned within said connecting plug of said melt supply head.

15. The melt spinning apparatus as defined in claim 14 wherein said melt spinning head is of an integral, one piece construction.

16. The melt spinning apparatus as defined in claim 1 wherein the axes of said duct chambers intersect at a location within said common inlet duct segment.

17. The melt spinning apparatus as defined in claim 1 wherein the axes of said duct chambers are parallel to each other and perpendicularly intersect the surface of said spin plate, and wherein said inlet end portions of said duct chambers each communicate with the downstream end of said common inlet duct segment and are in the form of a radial bore of relatively small diameter.

18. The melt spinning apparatus as defined in claim 1 wherein each of said filters is of elongate cup-shape and has a length generally corresponding to the length of its associated duct chamber.

19. The melt spinning apparatus as defined in claim 18 wherein each of said filters has a slightly conical outer surface so as to form a tapered cavity between the filter and the adjacent wall of the associated cylindrical duct chamber.

20. The melt spinning apparatus as defined in claim 1 further comprising means for supporting each of said filters in its associated duct chamber.

* * * * *